United States Patent [19]

Malkin

[11] 4,325,380

[45] Apr. 20, 1982

[54] ORTHOTIC DEVICE FOR THE HEEL OF A PERSON'S FOOT

[75] Inventor: Howard Malkin, East Brunswick, N.J.

[73] Assignee: Apex Foot Products Corporation, Englewood, N.J.

[21] Appl. No.: 168,776

[22] Filed: Jul. 11, 1980

[51] Int. Cl.[3] ..... A61F 5/14

[52] U.S. Cl. ..... 128/581; 128/614; 36/37

[58] Field of Search ..... 128/581, 583, 615, 614, 128/595; 36/37, 69

[56] References Cited

U.S. PATENT DOCUMENTS

| | | | |
|---|---|---|---|
| 1,244,027 | 10/1917 | Calvey | 128/614 |
| 1,299,983 | 4/1919 | Martyn et al. | 36/37 |
| 2,086,242 | 7/1937 | Sheridan | 36/37 X |
| 3,545,447 | 12/1970 | Silverman | 128/583 |
| 4,179,826 | 12/1979 | Davidson | 36/37 X |

*Primary Examiner*—John D. Yasko

*Attorney, Agent, or Firm*—Lerner, David, Littenberg & Samuel

[57] ABSTRACT

An orthotic device for the heel of a person's foot. The orthotic device includes a flexible cup-shaped body member adapted to surround the heel and adjacent portions of a person's foot when worn by the person. The cup-shaped body member includes an integral substantially solid heel cushion disposed on said body member in the vicinity of the heel of the person when the orthotic device is worn, three substantially solid rib members extending substantially longitudinally along the length of the bottom portion of the body member, and a tendon supporting portion provided on the cup-shaped body member which is adapted to surround and support a portion of the Achilles tendon when the orthotic device is worn. Relieved areas are provided on the cup-shaped body member for joining the heel cushion to the bottom portion and to the tendon supporting portion to permit limited freedom of movement of the heel cushion relative to the sole portion and the tendon supporting portion when the device is worn. One of the rib members comprises a central rib member, the surface of which lies substantially in the same plane as the bottom part of the heel cushion. The other rib members comprise lateral rib members laterally spaced on opposite sides of the central rib member. As such, the orthotic device provides the benefits of a solid cushioning heel portion while providing freedom and flexibility of movement thereof relative to the remaining portions of the orthotic device as a result of the relieved areas thereon.

17 Claims, 5 Drawing Figures

ORTHOTIC DEVICE FOR THE HEEL OF A PERSON'S FOOT

FIELD OF THE INVENTION

The present invention relates to orthotic devices, i.e., orthopedic appliances, for a person's foot, and more particularly to an orthotic device for the heel of a person's foot which, when worn, provides a cushioning support for the heel of a person's foot to relieve or minimize heel pressure and fatigue.

BACKGROUND OF THE INVENTION

Various types of orthotic devices for the foot or related parts thereof are known. For example, U.S. Pat. No. 2,821,032 is directed to an orthopedic appliance for correcting flat-footedness or other deformities of the human foot caused by an everted heel. The appliance or device of this reference comprises a one-piece substantially rigid scoop-shaped member which is adapted to conform snugly to the contour of the foot of an individual by whom it will be worn, and which embraces the heel of the wearer and extends forward of the foot so as to underlie the navicular or scaphoid bones of the foot. The upper and under surfaces of the bottom wall of the scoop-like member are substantially flat to provide a nonrolling or nonrocking anchor for the appliance under the weight of the wearer, and has generally vertical side and rear walls joined to the bottom wall on a rounded curve and shaped internally to conform to the outline of a normal heel to encase and firmly grip the everted heel medially, laterally and rearwardly. The front portion of the medial side wall is formed with a curvilinear convexed bulge portion extending horizontally of the wall to conform with the depression in the heel underlying the arch portion of a person's foot so that, when the device is worn, the weight on the inner or medial border of the forefoot is relieved.

However, because the orthotic device disclosed in this reference is made of substantially rigid plastic or metal, very little comfort and cushioning is provided for the heel of the wearer. The patented device is mainly intended to provide support to hold the heel in the proper or correct position to correct flat-footedness of the wearer as a result of an everted heel.

Heel cup protectors are also known which are comprised of a flexible molded polyethylene plastic which serves to give bilateral support to the "fat pad" under the heel of the wearer by forcing the fat or body tissue on the side of the person's heel to underlie the heel of the wearer. Again, however, because of the relatively rigid nature of the orthotic device (in order to force or give bilateral support to the fat pad), complete cushioning of the heel is not provided.

Furthermore, it is to be realized that with both of these prior art type of orthotic devices, very little flexibility and freedom of movement of the heel portion of a person's foot may be accommodated as, by the very nature of the devices, the heel is to be maintained in a fixed position with respect to the surrounding or adjacent portions of the foot. For example, with the device of U.S. Pat. No. 2,821,032, the position and orientation of the heel is to be maintained relative to a substantial portion of the sole of the wearer. Likewise, in the heel cup protectors of the prior art, the orientation of the heel is maintained in a relatively stationary, nonflexing position relative to the adjacent parts or portions of the foot, i.e., the Achilles tendon and/or the immediately adjacent portions of the sole of the foot.

While other types of orthotic devices for the heel of a person's foot are known which are of a more flexible nature and which do provide for increased shock absorbing benefits, these other prior art arrangements generally provide a ribbed configuration on the outside of the orthotic device as opposed to a solid heel cushion or pad for protecting and providing shock absorbing benefits to the heel. Consequently, such other devices do not provide any substantial support for the heel portion of the person's foot. That is, while some degree of cushioning or shock absorbing benefit is provided because of the flexible nature of the ribbed surface of such other orthotic device, the devices have proven to be too flexible and thus do not provide any substantial support for the heel of the wearer. For example, instead of maintaining the heel in an upright and correct position, the heel of the wearer may turn or roll sideways, thereby possibly resulting in injury to the tendons or ligaments of the foot. An example of such a type of orthotic device is taught in U.S. Pat. No. 4,179,826.

SUMMARY OF THE INVENTION

These and further disadvantages of the prior art are overcome and minimized in accordance with the orthotic device in accordance with the present invention. More particularly, the present invention provides an orthotic device for the heel of a person's foot which comprises a flexible cup-shaped body member adapted to surround the heel and adjacent portions of a person's foot when worn by the person. The flexible cup-shaped body includes an integral, substantially solid heel cushion disposed on the body member in the vicinity of the heel of a person when the orthotic device is worn. The flexible cup-shaped body member further includes a sole supporting portion which extends along a portion of the sole of the person's foot when worn, and a tendon supporting portion adapted to surround and support a portion of the Achilles tendon when the device is worn. The flexible cup-shaped body member includes relieved areas joining the heel cushion to the sole supporting and tendon supporting portions to permit limited freedom of movement of the heel cushion relative to the sole supporting and tendon supporting portions when the device is worn. In this manner, the heel cushion thus serves to provide for cushioning protection of a person's foot, even during twisting and flexing movement of the person's foot, since the heel cushion may remain in position to surround and support the heel. That is, the orthotic device of the present invention provides the benefits of a solid cushioning heel member while at the same time providing limited freedom and flexibility of movement of the sole and Archilles tendon portions of the foot relative to the heel by virtue of the relieved areas joining the heel cushion to the sole supporting and tendon supporting portions of the orthotic device.

In another aspect of the present invention, the orthotic device comprises a flexible cup-shaped body member adapted to surround the heel and adjacent portions of the person's foot when worn by the person. The flexible cup-shaped body member also includes a bottom portion extending longitudinally along a portion of the sole of the person's foot when worn. An integral substantially solid heel cushion is disposed on the cup-shaped body in the vicinity of the heel of the person's foot when the device is worn by a person, the heel cushion being raised relative to the surface of the body member and including side, back and bottom parts for cushioning, supporting and protecting the person's heel. Along the length of the bottom portion of the cup-shaped body member there is provided three substantially solid rib members. One of the rib members comprises a central rib member which is raised from the surface of the cup-shaped body member to be in substantially the same plane as the bottom part of the heel cushion, and the other rib members comprise lateral rib members laterally spaced on opposite sides of the central rib member. In this manner, the central rib member serves to stabilize and balance the orthotic device against rocking which might otherwise result from the raised heel cushion. The lateral rib members in turn serve to stabilize the orthotic device against side to side roll. The lateral rib members preferably normally lie above the plane of the central rib member when the device is not worn. On the other hand, when the device is worn, the lateral rib members serve to engage the surface and stabilize the orthotic device against side to side roll during twisting and bending movement of the wearer's foot.

Further, in accordance with a preferred embodiment of the present invention, the orthotic device is made entirely of a polyurethane material.

These and further features and characteristics of the present invention will be more apparent from the following detailed description in which reference is made to the enclosed drawings which illustrate a preferred embodiment of the present invention.

DETAILED DESCRIPTION OF THE PREFERRED EMBODIMENT

Figure 1:
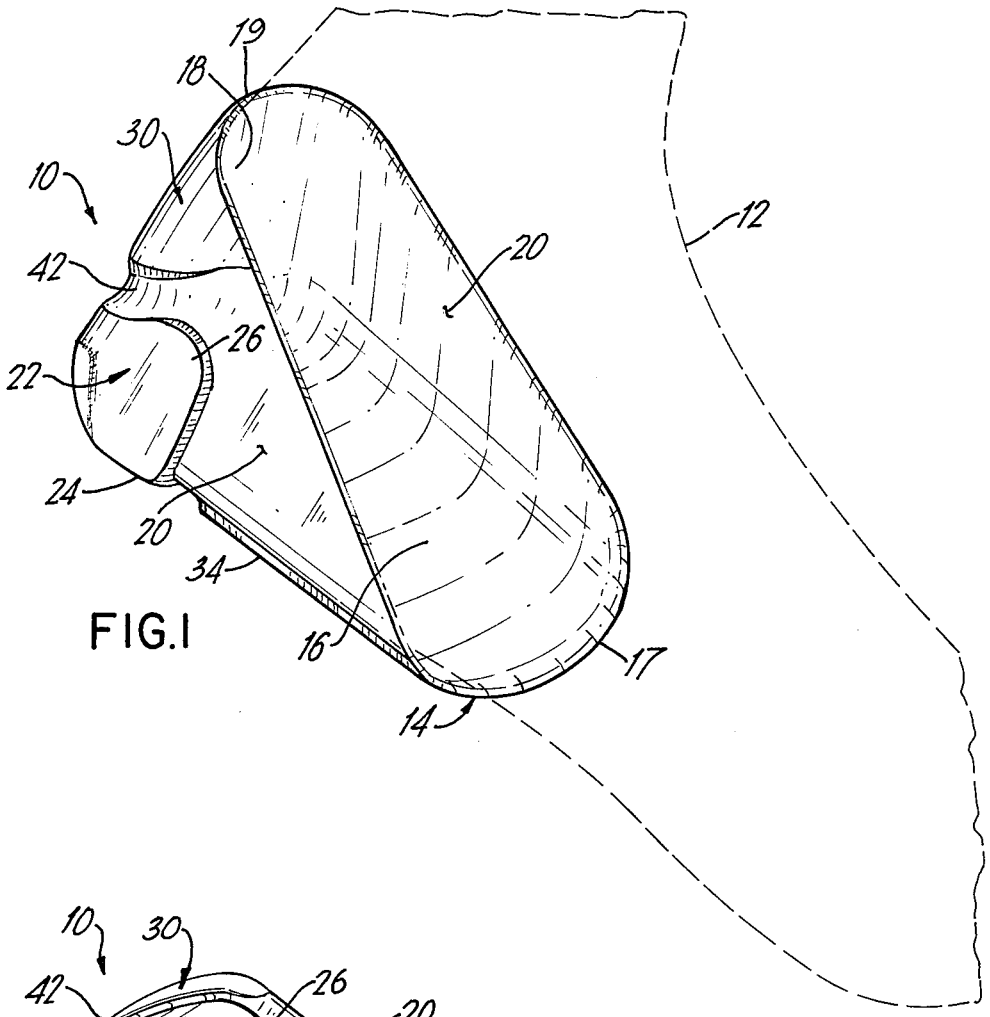
FIG. 1 is a top perspective view of the orthotic device in accordance with the present invention, the device being adapted to surround the heel and adjacent portions of a person's foot (shown in dotted outline) when worn, such as for example when the orthotic device is placed within the shoe of the wearer.
Figure 2:
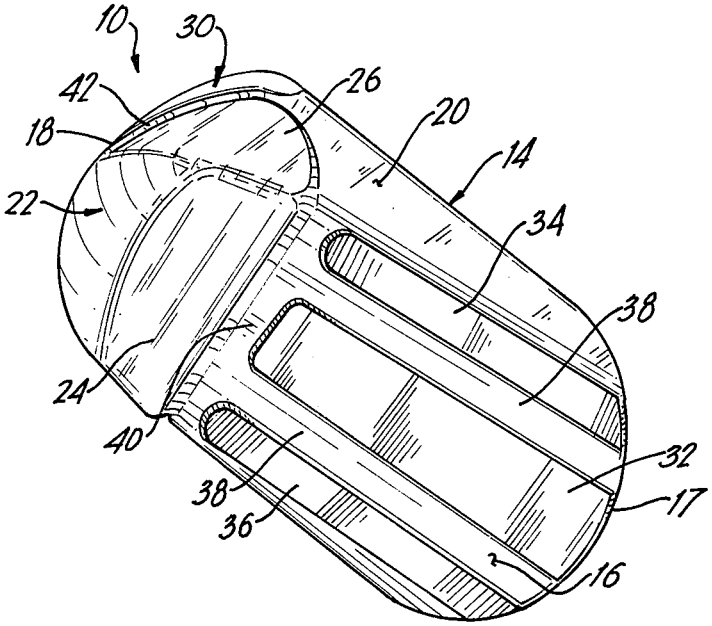
FIG. 2 is a bottom perspective view of the orthotic device in accordance with the present invention, illustrating the heel cushion, rib members and tendon supporting portion along respective portions thereof.
Figure 5:
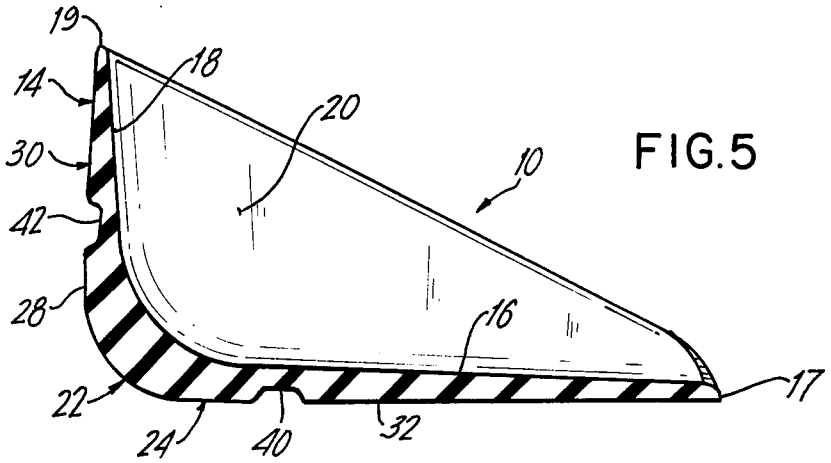
FIG. 5 is a side sectional view of the orthotic device in accordance with the present invention, taken along lines 5—5 of FIG. 4.

Referring now to the drawings wherein like reference characters represent like elements, there is shown in perspective in FIGS. 1 and 2 the orthotic device 10 in accordance with the present invention for cushioning and supporting the heel of a person's foot 12 when worn. The orthotic device 10 includes a generally flexible cup-shaped body member 14 which is adapted to surround and conform to the heel portion of a person's foot 12 when worn, shown in dotted outline in FIG. 1. More particularly, the cup-shaped body member 14, which has a substantially right triangular cross-section (see FIGS. 3 and 5), includes a bottom portion 16, a rear wall portion 18 and side wall portions 20 which thus surround the heel and adjacent portions of the person's foot 12 when worn. Specifically, the heel of the person's foot 12 is adapted to engage the lower part of the rear wall portion 18 and the rear part of the bottom portion 16 when worn. The bottom portion 16 extends slightly beyond the forward part of the wearer's heel area, i.e., to underlie the approximate edge of the navicular or scaphoid bone of the foot 12. The side wall portions 20 of the cup-shaped body member 14 lie along the side of the heel area of the person's foot 12 and connect, in a generally triangular manner, the forward edge 17 of the bottom portion 16 to the top edge 19 of the rear wall portion 18.

As best seen in FIG. 2, the flexible cup-shaped body member 14 has disposed on the outer surface thereof an integral, substantially solid heel cushion 22 which includes a bottom part 24, side parts 26 and a rear part 28. The heel cushion 22 is disposed in the vicinity of the lower rear heel area of the body shaped member 14 and substantially corresponds in shape to the cup-shaped body member 14 in such lower rear portion. The heel cushion 22 thus provides support for the bottom, rear and sides of the heel of a person's foot 12 when worn, and, because of its substantial thickness and integral nature, also serves to provide a shock absorbing cushion therefor.

Above the heel cushion 22 and provided on the rear wall portion 18 and a part of the side wall portions 20 of the cup-shaped body member 14 is a tendon supporting portion 30. As with the heel cushion 22, the tendon supporting portion 30 is of a solid integral construction of an increased thickness which smoothly tapers onto the side wall portions 20 of the cup-shaped body member 14. The tendon supporting portion 30 serves to surround and support a portion of the Achilles tendon when the orthotic device 10 is worn, and in particular provides a cushioning effect against any impact which may strike the rear portion of the person's foot 12. Also, the tendon supporting portion 30 serves to fill up space in the shoe when the device 10 is worn so that the shoe and the tendon supporting portion 30 will cooperate to protect the Achilles tendon of the wearer.

Along the bottom portion 16 of the cup-shaped body member 14 there is provided a sole supporting portion comprised of three longitudinally extending, parallel rib members 32, 34, 36, which are raised from the outer surface of the bottom portion 16 of the cup-shaped body member 14, as with the heel cushion 22 and tendon supporting portions 30. The bottom surface of the central rib member 32 lies in substantially the same plane as the bottom part 24 of the heel cushion 22 so as to provide balance and stability against rocking of the orthotic device 10. The central rib 32 is of a somewhat substantial width, and extends from the forward edge 17 of the bottom portion 16 of the orthotic device 10 rearwardly to a point spaced from the heel cushion 22, as can best be seen in FIGS. 2, 3 and 5. The other two rib members 34, 36 are also raised from the outer surface of the cup-shaped body member 14 and are spacedly disposed on laterally opposite sides of the central rib member 32. The lateral rib members 34, 36 are each of a narrower width than the central rib member 32 and extend from the forward edge portion 17 of the orthotic device 10 rearwardly to a point spaced from the heel cushion 22.

Figure 3:
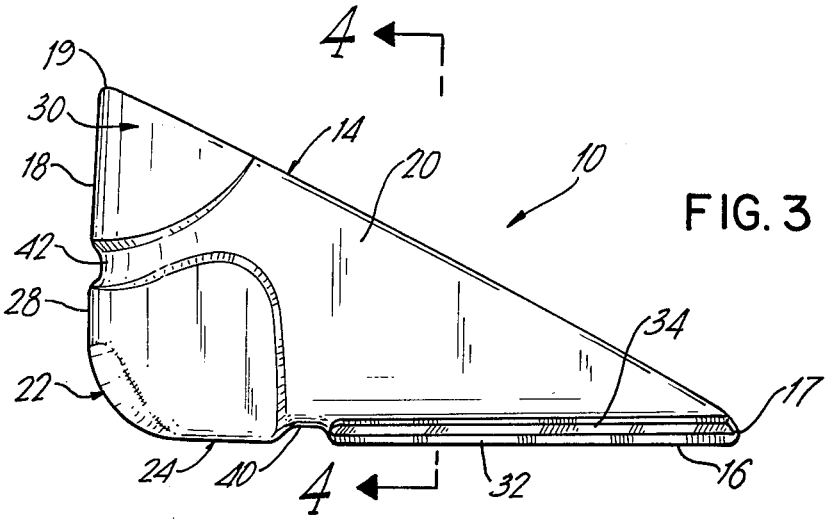
FIG. 3 is a side elevational view of the orthotic device in accordance with the present invention, illustrating the heel cushion, rib members and tendon supporting portions thereof as disposed on the cup-like body member.
Figure 4:
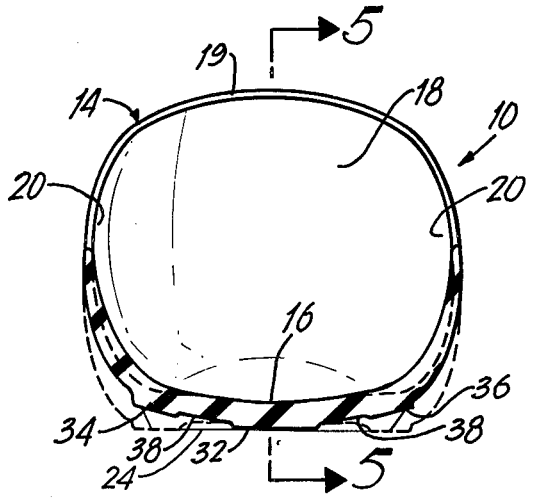
FIG. 4 is an end sectional view of the orthotic device in accordance with the present invention, taken along lines 4—4 of FIG. 3.

The bottom or outer surfaces of these lateral rib members 34, 36 are spaced from the plane of the bottom surface of the central rib member 32 so that when the orthotic device 10 is placed on a flat surface, these lateral rib members are spaced above such surface, as can best be seen in FIG. 3 and in solid outline in FIG. 4. However, when worn by a person, the weight placed by the person's foot 12 causes the lateral rib members 34, 36 to engage the surface on which it is supported (i.e., the inside surface of a shoe or boot in which it is worn). This is shown in dotted outline in FIG. 4. These lateral rib members 34, 36 thus serve to stabilize the orthotic device 10 against side to side roll when a person's foot 12 is twisted or turned sideways.

It will be appreciated that by virtue of the raised nature of the heel cushion 22, the rib members 32, 34, 36 and the tendon supporting portion 30 relative to the outer surface of the cup-shaped body member 14, the area between the heel cushion 22, the rib members 32, 34, 36 and the tendon supporting portion 30 define relieved areas 38, 40, 42 of the orthotic device 10 of a reduced thickness which serve to join the heel cushion 22 to the rib members 32, 34, 36 (i.e., relieved area 40) and the heel cushion 22 to the tendon supporting portion 30 (i.e., relieved area 42). Thus, the heel cushion 22 is isolated in a sense from the bottom rib members 32, 34, 36 and from the tendon supporting portion 30. Accordingly, because of the reduced thickness of the cup-shaped body member 14 in the relieved areas 38, 40, 42, a limited degree of freedom and flexibility of movement of the heel cushion 22 relative to the sole supporting (i.e., the rib members 32, 34, 36) and tendon supporting portions 30 of the orthotic device 10 is permitted. That is, by virtue of these relieved areas 38, 40, 42, the heel cushion 22 may move to a limited extent relative to the sole supporting portions 32, 34, 36 and tendon supporting portion 30 during twisting and flexing movement of the person's foot 12 so that the heel cushion 22 remains in position against the heel of the person's foot 12. This arrangement thus provides the benefits of a solid cushioning heel portion without the previously encountered limits on flexibility and freedom of movement during bending and flexing or twisting movements of the person's foot 12. In other words, in accordance with the present invention, the heel cushion 22 may move during flexing and bending or twisting of the person's foot 12 so that it remains in position to provide the desired cushioning or shock absorbing effect during limited movements and flexing of the foot 12. This feature is most important, particularly with respect to use of the orthotic device 10 by athletes and the like in which the foot 12 is constantly being flexed, twisted or bent.

On the other hand, with prior art arrangements which provided a solid heel cushioning portion, because of the rigidity of the prior art devices, limited freedom or flexibility of movement of the heel portion relative to the sole and/or tendon portions of the foot could not be accommodated. Thus, either the heel of the person's foot was restrained against such movement and/or the orthotic device would move relative to the heel of the foot and not provide the desired shock absorbing or cushioning effect. That is, with prior art arrangements, either twisting, flexing or bending of the foot was inhibited, or the desired shock absorbing or cushioning effect could not be appreciated.

Furthermore, it will be appreciated that by virtue of the side 26, rear 28 and bottom 24 portions of the heel cushion 22, substantial support for the heel of the wearer is provided, even during flexing, twisting, or bending of the person's foot 12. Because of the increased thickness and cushioning provided by the heel cushion 22 on the body member 14, shifting of the weight of the person, for example to the inside of the heel, will be resisted by the lateral or side parts 26 of the heel cushion 22. In other words, the side parts 26 of the heel cushion 22 provide lateral support for the heel when the device 10 is worn. Similarly, rear support is provided by the rear part 28 of the integral, substantially solid heel cushion 22. This is in contrast to certain prior art devices which only provide desired cushioning along the rear and bottom portions of the orthotic device but which provided no lateral stability or cushioning when the weight of the wearer is shifted.

Also, in accordance with the present invention, the entire orthotic device 10 is preferably manufactured of a polyurethane material which is very lightweight and has a long life, yet still possesses the desired flexibility, and strength and resiliency for providing for good shock absorption or cushioning. Further, it is to be noted that such polyurethane materials are easily moldable into the desired configuration, and in particular to provide the recessed areas 38, 40, 42 in accordance with the present invention joining the thickened heel cushion 22 to the thickened tendon supporting portion 30 and sole supporting portion 32, 34, 36 of the orthotic device 10.

In this regard, it is preferred that a blown-in polyurethane material be utilized in which the components are mixed, placed in a mold cavity and then heated to produce the desired chemical reaction of the components. During this process, the mixed components expand to fill the mold cavity and then set to produce the finished orthotic device 10. During the chemical reaction and expansion in the mold cavity, some air will be entrapped in the material in the thickened or enlarged areas of the cavity (e.g., the portion for forming the heel cushion 22) which will thus produce a relatively more flexible, resilient cushion material than is produced in the thinner or smaller portions of the mold cavity. This is particularly advantageous because it provides for better shock absorbing or cushioning for the heel cushion on the orthotic device. One isocyanate-polyol mixture used to produce a polyurethane material which is suitable for producing the orthotic device 10 is marketed by Mobay Chemical Company under the tradename "Bayflex". Of course, the orthotic device 10 could also be made of other types of polyurethane materials or elastomeric materials, such as for example rubber, which possesses the desired strength, flexibility and resiliency.

Accordingly, it will be appreciated that in accordance with the present invention there is provided an orthotic device 10 for the heel of a person's foot 12 which comprises a flexible cup-shaped body member 14 adapted to surround the heel and adjacent portions of a person's foot 12 when worn. The cup-shaped body member 14 has disposed thereon an integral substantially solid heel cushion 22 disposed in the vicinity of the heel of the person's foot when worn for supporting and providing cushioning for the heel of the foot 12. A sole supporting portion 32, 34, 36 is also provided on the flexible cup-shaped body member 14 for supporting a portion of the sole of the foot 12 when the device 10 is worn, as well as a tendon supporting portion 30 for surrounding and supporting a portion of the Achilles tendon when worn. The flexible cup-shaped body member 14 includes relieved areas 38, 40, 42 which join the heel cushion 22 to the sole supporting portion 32, 34, 36 and tendon supporting portion 30 to permit limited freedom of movement of the heel cushion 22 relative to the sole supporting portion 32, 34, 36 and tendon supporting portion 30 when worn. Also, in accordance with a preferred embodiment, the sole supporting portion 32, 34, 36 comprises three rib members 32, 34, 36 provided on the bottom portion 16 of the cup-shaped body member 14. One of the rib members comprises a central rib member 32, the surface of which is in substantially the same plane as the bottom part 24 of the heel cushion 22 for providing balance and stability to the orthotic device 10. The other rib members comprise lateral rib members 34, 36 laterally spaced on opposite sides of the central rib member 32. These lateral rib members 34, 36 serve to stabilize the orthotic device 10 against side to side roll.

While the preferred embodiment of the present invention has been shown and described, it will be understood that such is merely illustrative and that changes may be made without departing from the scope of the invention as claimed.

What is claimed is:

1. An orthotic device for the heel of a person's foot, the orthotic device comprising:

a flexible, cup-shaped body member adapted to surround the heel and adjacent portions of a person's foot when worn, the cup-shaped body member including a bottom portion extending longitudinally along a portion of the sole of the person's foot when worn by the person;

an integral substantially solid heel cushion disposed on said cup-shaped body member in the vicinity of the heel of the person's foot when worn by the person, said heel cushion being raised relative to the surface of said body member and including side, back and bottom parts for cushioning and protecting the person's heel; and three substantially solid rib members extending substantially longitudinally along the length of said bottom portion of said body member, each rib member being of a width greater than its height, one of said rib members comprising a central rib member raised from the surface of said cup-shaped body member to be in substantially the same plane as said bottom part of said heel cushion so that it cooperates with the bottom part of said heel cushion to provide balance and stability against rocking of the orthotic device, and the other of said rib members being raised from the surface of said cup-shaped body member and comprising lateral rib members laterally spaced on opposite sides of said central rib member to stabilize the orthotic device against side to side roll.

2. The orthotic device of claim 1 wherein said flexible cup-shaped body member, said heel cushion, and said rib members are made of polyurethane material.

3. The orthotic device of claim 1 wherein said three rib members are substantially parallel to one another.

4. The orthotic device of claim 3 wherein the lateral dimension of said central rib member is greater than the lateral dimension of said lateral rib members.

5. The orthotic device of claim 4 wherein the surfaces of said lateral rib members are spaced from the plane of said central rib member.

6. The orthotic device of claim 1 further including a raised tendon supporting portion on said body member spaced from said heel cushion for supporting and protecting a portion of the Achilles tendon when said orthotic device is worn by a person.

7. The orthotic device of claim 6 wherein said heel cushion and said rib members are spacedly disposed from one another on said cup-shaped body member.

8. The orthotic device of claim 7 wherein said tendon supporting portion is spacedly disposed from said heel cushion and from said rib members on said cup-shaped body member.

9. The orthotic device of claim 8 wherein said flexible cup-shaped body member includes relieved areas joining said heel cushion to said rib members and to said tendon supporting portion to permit limited freedom of movement of said heel cushion relative to said rib members and said tendon supporting portion when worn.

10. An orthotic device for the heel of a person's foot, said orthotic device comprising:

a flexible cup-shaped body member adapted to surround the heel and adjacent portions of a person's foot when worn, said flexible cup-shaped body including an integral, substantially solid heel cushion disposed thereon in the vicinity of the heel of a person when said orthotic device is worn, a sole supporting portion adapted to extend along a portion of the sole of a person's foot when worn, and a tendon supporting portion adapted to surround and support a portion of the Achilles tendon when worn; and said flexible cup-shaped body member including relieved areas which separate said heel cushion from said sole supporting portion and from said tendon supporting portion to permit limited freedom of movement of said heel cushion relative to said sole supporting portion and said tendon supporting portion when worn.

11. The orthotic device of claim 10 wherein said flexible cup-shaped body member, said heel cushion, said sole supporting portion and said tendon supporting portion are made from a polyurethane material.

12. The orthotic device of claim 10 wherein said sole supporting portion comprises a plurality of substantially solid, longitudinally extending rib members defined by relieved portions on said cup-shaped body member.

13. The orthotic device of claim 12 wherein said heel cushion includes side, back and bottom parts for cushioning and protecting the person's heel when worn, and wherein one of said rib members comprises a central rib member which is in substantially the same plane as said bottom part of said heel cushion.

14. The orthotic device of claim 13 wherein the other of said rib members comprise lateral rib members laterally spaced on the opposite sides of said central rib member and substantially parallel thereto.

15. The orthotic device of claim 14 wherein the surfaces of said lateral rib members are spaced from the plane of said central rib member.

16. The orthotic device of claim 1 wherein said heel cushion and said rib members are spacedly disposed from one another on said cup-shaped body member.

17. An orthotic device for the heel of a person's foot, said orthotic device comprising:

a flexible cup-shaped body member adapted to surround the heel and adjacent portions of a person's foot when worn, said flexible cup-shaped body including an integral, substantially solid heel cushion disposed thereon in the vicinity of the heel of a person when said orthotic device is worn, and a sole supporting portion adapted to extend along a portion of the sole of a person's foot when worn; and said flexible cup-shaped body member further includes a relieved area which separates said heel cushion from said sole supporting cushion to permit limited freedom of movement of said heel cushion relative to said sole supporting portion when worn.

* * * * *